US005107166A

United States Patent [19]

Hauser et al.

[11] Patent Number: 5,107,166

[45] Date of Patent: Apr. 21, 1992

[54] ELECTRON BEAM COLLECTOR ASSEMBLY FOR A VELOCITY MODULATED TUBE

[75] Inventors: Josef Hauser, Bad Wiessee; Peter Mammach, Unterhaching, both of Fed. Rep. of Germany

[73] Assignee: Siemens Aktiengesellschaft, Munich, Fed. Rep. of Germany

[21] Appl. No.: 405,651

[22] Filed: Sep. 11, 1989

[30] Foreign Application Priority Data

Sep. 30, 1988 [DE] Fed. Rep. of Germany ..... 3833312

[51] Int. Cl.[5] ..... H01J 25/34; H01J 7/24

[52] U.S. Cl. ..... 313/38; 313/17; 313/30; 315/3.5; 315/5.38

[58] Field of Search ..... 313/17, 30, 38, 39, 313/40, 41, 45; 315/3.5, 5.38

[56] References Cited

U.S. PATENT DOCUMENTS

| | | | |
|---|---|---|---|
| 3,359,451 | 12/1967 | Zitelli et al. | 315/5.38 |
| 3,586,100 | 6/1971 | Yasuda | 313/40 X |
| 3,626.230 | 12/1971 | Stewart et al. | 315/3.5 X |
| 3,748,513 | 7/1973 | Levin | 313/36 X |
| 3,930,182 | 12/1975 | Bretting | 315/5.38 X |
| 3,995,193 | 11/1976 | Horigome et al. | 315/5.38 |
| 4,000,438 | 12/1976 | Sarnezki | 315/3.5 |
| 4,558,258 | 12/1985 | Miyake | 315/5.51 X |
| 4,840,595 | 6/1989 | Bibracher et al. | 455/28 |

FOREIGN PATENT DOCUMENTS

| | | |
|---|---|---|
| 1564629 | 5/1973 | Fed. Rep. of Germany . |
| 2213185 | 9/1973 | Fed. Rep. of Germany . |
| 2449890 | 6/1976 | Fed. Rep. of Germany . |
| 2219518 | 9/1974 | France . |

*Primary Examiner*—Donald J. Yusko
*Assistant Examiner*—Ashok Patel
*Attorney, Agent, or Firm*—Hill, Van Santen, Steadman & Simpson

[57] ABSTRACT

In a traveling wave tube, an electron beam collector and an electrically insulating cylinder having good thermal conductivity and dielectric strength are arranged in a bore of a cooling housing to improve heat elimination from the electron beam collector. The cylinder is deformable in a radial direction, is of an elastic material, and is dimensioned so that it fixes the electron beam collector in the bore of the housing with a tight fit.

8 Claims, 1 Drawing Sheet

ELECTRON BEAM COLLECTOR ASSEMBLY FOR A VELOCITY MODULATED TUBE

BACKGROUND OF THE INVENTION

1. Field of the Invention

The present invention is directed generally to a velocity-modulated tube having an electron collector surrounded by a cooling housing.

2. Description of the Related Art

A velocity-modulated tube is disclosed in German Published Application 22 13 185. As disclosed therein, a possibility of centering is provided after the introduction of the electron beam collector in that one part of a bore in a cooling housing is filled with an insulating compound having good thermal conductivity after the electron beam catcher is adjusted in a radial direction in the bore. In the disclosed method, the dielectric strength of the material is not fully exploited since different wall thicknesses arise in the introduced insulating compound after adjustment of the catcher in a circumferential direction. There is also a risk in the disclosed method that gas inclusions may occur during introduction of the compound, which can lead to voltage outages.

SUMMARY OF THE INVENTION

An object of the present invention is to provide a dielectric and good thermal conducting connection between an electron beam collector and a cooling housing of a velocity-modulated tube, and in particular a traveling wave tube. The traveling wave tube, for instance, includes an electron beam collector surrounded by an electrically insulating cylinder having good thermal conductivity whereby the cylinder is inserted into a bore of the cooling housing and is joined to the electron beam collector in a mechanically rigid fashion with good thermal conductivity. The velocity-modulated tube according to the present invention is especially resistant to damage due to temperature changes and is simple to manufacture.

These and other objects of the invention are achieved when the cylinder of the velocity-modulated tube is composed of a material that is elastic and compressible in a radial direction, the cylinder being compressed between the bore of the cooling housing and the electron beam collector so that a mechanically rigid connection is provided between the cooling housing, the cylinder, and the electron beam collector. The cylinder electrically insulates the housing from the collector, as well.

The cylinder of the present invention is compressed by the wall of the bore in the cooling housing and is pressed by the bore wall against the electron beam collector. A mechanically firm connection between the housing, the cylinder, and the electron beam collector is thus guaranteed. This applies for the entire operating temperature range, of the traveling wave tube and even in the case of rapid temperature fluctuations.

The operating temperature range of a traveling wave tube generally lies at, for example, 300° C., so that the present invention is to provide a faultless adhesion and a very good thermal conduction between the three parts, at least in the temperature range between room temperature and 300° C.

The materials which are suitable for forming the cylinder include a temperature resistant, rubber elastic substances and elastic substances having a low porosity and a low hardness. Given a pressure force from a single side, a rubber elastic substance yields elastically in arbitrary directions which differ from the force direction. Boron nitride has proven particularly suitable for use as the material of which the cylinder is formed. Boron nitride has the required elasticity, remains shape-stable to more than 300° C. (and even up to 1000° C.), is highly electrically insulating, and may be compressed in a radial direction to the required degree. Boron nitride also has an especially high thermal conductivity and is sufficiently soft that it can be impressed into uneven adjacent surfaces to guarantee little resistance to heat transmission between the adjacent materials.

A particularly suitable method for manufacture of an article according to the invention provides that the inside diameter of the cylinder be selected slightly larger than the outside diameter of the electron beam collector. The diameter of the bore in the cooling housing is selected to be somewhat smaller than the outside diameter of the cylinder. The cylinder is slipped over the electron beam collector and is kept at a first temperature, while the housing is heated to a second temperature which is higher in comparison to the first temperature so that the diameter of the bore in the housing at the higher temperature becomes larger than the outside diameter of the cylinder. The electron beam collector together with the cylinder is then pushed into the bore of the heated housing. As the temperatures of the different parts equalize, the surface walls of the bore in the housing press the cylinder and produce a connection of the parts.

Insofar as the coefficient of thermal expansion of the electron beam collector and that of the cooling housing are of approximately the same size and/or the elasticity of the cylinder is adequate to intercept changes in diameter caused by temperature, the connection is preserved with a uniform quality over the entire operating temperature range of the traveling wave tube.

The present arrangement produced according to the proposed method differs significantly from arrangements wherein a cylinder is held by clamping which presses the bore of the cooling housing together. In a clamping arrangement, a deformation of the housing in the region of the bore is fundamentally produced and, as a result thereof, the cylinder is clamped. This deformation of the housing at least results in an unequal distribution of tension, or pressure, in the cylinder which causes an asymmetry in the heat dissipation and in the dielectric strength.

Given the use of a relatively soft substance for the cylinder such as a plastic or plastic film, additional material is scraped off as soon as a gap is provided, the latter being pressed together for diminishing the bore.

German Patent 24 49 506 discloses the use of film instead of a cylinder. A noticeable reduction in the dielectric strength arises that cannot be explained without further ado based on the change in the cross-sectional area of the film during the compression.

When, instead, a cylinder of boron nitride is used, a faultless fixing of the collector in the cooling housing is achieved when, before assembly, the bore in the cooling is approximately 0.3% smaller at room temperature than the outside diameter of the cylinder and when the inside diameter of the cylinder is dimensioned approximately 0.2% larger than the outside diameter of the collector. A simple execution of the present method is guaranteed in that the cylinder is kept at room temperature and the housing is heated to at least approximately 300° C.

DETAILED DESCRIPTION OF THE PREFERRED EMBODIMENTS

Figure 1:
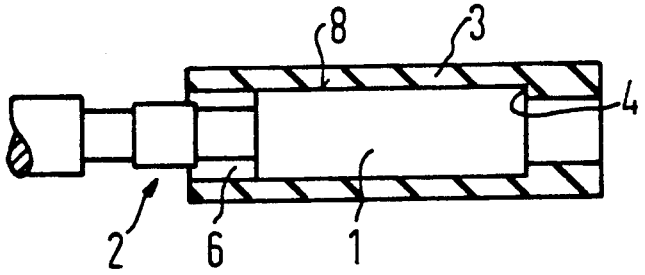
FIG. 1 is a schematic representation, partially in cross section, of an electron beam collector with a slip-on cylinder.

An electron beam collector 1 is shown in FIG. 1 attached to an end of a traveling wave tube 2. A cylinder 3 is slipped onto the catcher 1. The cylinder 3 has a bore 6 with a first internal surface portion 9 of a first diameter and includes a diameter discontinuity which forms a detent 4 against which the end of the electron beam collector 1 lies thereby forming a second internal surface portion 10 of a second diameter, the second diameter having less than the first diameter. The arrangement illustrated in FIG. 1 is kept at a low temperature, and preferably at room temperature.

Figure 2:
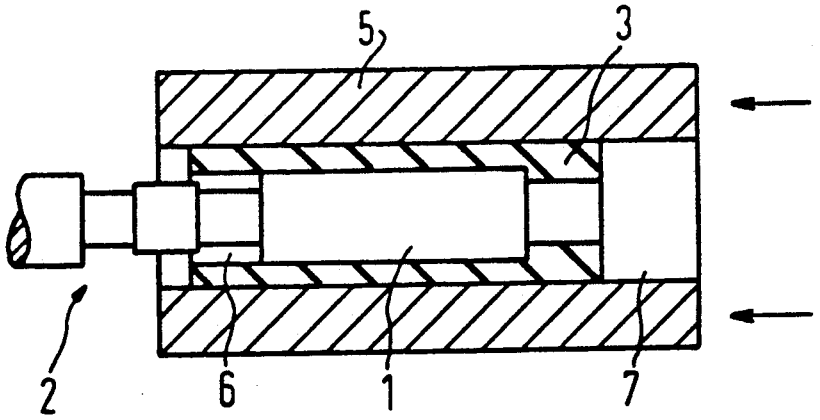
FIG. 2 is a schematic view, partially in crosssection, of the collector and cylinder of FIG. 1 shown with a cooling housing shrunk thereon.

With reference to FIG. 2, a cooling housing 5 having a bore 7 is slipped onto the cylinder 3 in the direction of the arrows S, the cooling housing being heated to a heated condition. After being slipped onto the cylinder 3, the temperatures of the parts 1 through 5 adapt to one another which causes a press fit of the required quality to arise.

A particularly suitable material for the cylinder 3 is boron nitride, which fills out all the unevenness in the bore 7 of the cooling housing and on surface 8 of the electron beam collector 1. This, therefore, guarantees an especially low heat transmission resistance between the parts 1, 3, and 5. Boron nitride is a high-grade electrical insulator. Arc-overs in the axial direction are avoided in that the axial expanse of the cylinder 3 is greater by appropriate insulating distance than the axial expanse of the electron beam collector. The outside diameter of the cylinder lies between approximately 10 mm and 20 mm. In one example, the outside diameter of the cylinder 3 is 15 mm and the inside diameter of the cylinder is approximately 12 mm.

Thus there has been shown and described a simple and easily manufactured means for heat elimination in an electron beam collector for use in traveling wave tubes and particularly at high operating temperatures.

We claim:

1. An electron beam catcher assembly, comprising:

an electron beam collector having an outside surface;

a one-piece continuous cylinder mounted over said outside surface of said electron beam collector, said one-piece cylinder consisting of electrically insulating thermally conductive material that is elastic and radially compressible; and a housing mounted over said one-piece cylinder and radially compressing said one-piece cylinder onto said outside surface of said electron beam collector forming continuous, mechanically firm, thermally conductive connections between said housing and said one-piece cylinder and between said one-piece cylinder and said electron beam collector.

2. An electron beam catcher assembly as claimed in claim 1, wherein said one-piece cylinder is composed of an insulating material of low porosity.

3. An electron beam catcher assembly as claimed in claim 1, wherein said one-piece cylinder is composed of a material having low hardness.

4. An electron beam catcher assembly as claimed in claim 1, wherein said one-piece cylinder is of a material that is shape-stable at least up to 300° C.

5. An electron beam catcher assembly as claimed in claim 1, wherein said one-piece cylinder has an outside surface of a first diameter at room temperature, and said housing has an inside surface of a diameter smaller than said first diameter at room temperature.

6. An electron beam catcher assembly as claimed in claim 5, wherein said first diameter is approximately 0.3% larger than said inside diameter of said housing at room temperature.

7. An electron beam catcher assembly as claimed in claim 1, wherein said one-piece cylinder consists of boron nitride.

8. An electron beam catcher assembly as claimed in claim 1, wherein said one-piece cylinder has a first internal surface portion of a first internal diameter for mounting over said electron beam collector and a second internal surface portion of a second internal diameter, said second internal diameter being less than said first internal diameter.

* * * * *